US005365918A

United States Patent [19]

Smith et al.

[11] Patent Number: 5,365,918

[45] Date of Patent: Nov. 22, 1994

[54] OVEN WITH SHORT RADIUS DOOR

[75] Inventors: Donald P. Smith, Dallas; Jarald E. High, Grand Prairie, both of Tex.

[73] Assignee: Patentsmith Corporation, Dallas, Tex.

[21] Appl. No.: 962,897

[22] Filed: Oct. 16, 1992

[51] Int. Cl.[5] ..... A21B 1/00

[52] U.S. Cl. ..... 126/21 A; 126/21 R; 99/474; 99/339

[58] Field of Search ..... 126/21 A, 21 R, 273 R, 126/41 A; 432/142; 219/388; 99/474, 339, 331

[56] References Cited

U.S. PATENT DOCUMENTS

| | | | |
|---|---|---|---|
| 4,116,620 | 9/1978 | Stibbe | 432/59 |
| 4,506,652 | 3/1985 | Baker et al. | 126/21 A |
| 4,781,169 | 11/1988 | Henke et al. | 126/21 A |
| 4,862,792 | 9/1989 | Lerma, Jr. | 126/25 R |
| 5,184,599 | 2/1993 | Stuart | 126/25 R |

*Primary Examiner*—Larry Jones

*Attorney, Agent, or Firm*—John W. Montgomery

[57] ABSTRACT

An oven with a heated interior volume, an access into the heated interior volume, and a door mounted adjacent to the heated interior volume for pivoting between closed access and opened access positions and having a concave interior surface defining an interior space adjacent to the heated interior volume.

47 Claims, 6 Drawing Sheets

OVEN WITH SHORT RADIUS DOOR

TECHNICAL FIELD OF THE INVENTION

The present invention relates to an oven and an oven door, and in particular, to an oven with a door having a concave interior surface, and more particularly to an oven door with a concave interior which is hinged at one side so that it opens about a short radius, and which short radius oven door may support a rotatable cooking tray within a portion of its concave interior, so that the cooking tray swings out of the interior of the oven when the oven door is opened.

BACKGROUND OF THE INVENTION

Many ovens and oven configurations have been designed in order to facilitate or enhance various aspects of use and operation.

For example, conveyor ovens have been designed and constructed which carry a food product on a wire mesh conveyor so that cooking or heating processes are applied to the food as the conveyor moves the food product through the oven. In order to accommodate the conveyor, such ovens typically have an open entrance and an open exit which may be shielded, but which nevertheless allows heated air and radiation transfer between the interior and the exterior of the oven through the open passages.

Various ovens have been known in which the door essentially comprises a flat surface which sealingly abuts against the perimeter face of a rectangular opening. Typical household ovens are of this type and they usually have a wide interior opening to facilitate loading and unloading of the oven. Loading and unloading is also facilitated with slidable racks or wire shelves. These racks typically must be separately slid in and out after the oven door is fully open.

Other ovens, such as pizza restaurant ovens, have been designed with close top to bottom spacing in which the food product is inserted by an operator with an elongated peel. Without a peel or similar long-handled tool, the operator would risk burning injuries by sticking a hand into the oven.

Ovens have been constructed and tested which have a door-mounted rack for facilitating loading and unloading as the rack pivots with the door into and out of the heated oven area. One example of an oven with a door-mounted rotary rack is disclosed in U.S. Pat. No. 4,924,763 to Bingham. The rack can be conveniently loaded when the door is swung open. The food is automatically placed in the heated section upon closing the door. Some racks have been made rotatable to facilitate even heating and food processing as desired.

Previously, door-mounted motors for driving a rotatable rack has projected outward from the door in a cumbersome fashion requiring additional clearance space for the oven. Ovens as in co-pending U.S. application Ser. No. 07/699,774, filed May 14, 1991, co-owned herewith, have solved numerous oven access problems associated with prior known ovens which were not equipped with door-mounted heating racks.

However, most typically, the foregoing closable ovens required adequate clearance space exterior to the oven, which clearance space had to be equal to the radius of the door measured from the hinge to the maximum point on the door or on any door-mounted rack. Particularly in the case of an oven with a door-mounted rotatable rack having a diameter equal to the door width, the door had to be opened nearly to its 90° position with respect to the face of the oven so that the rack could be accessed.

SUMMARY OF THE INVENTION

The present invention overcomes many of the deficiencies of previously known ovens with flat oven doors by providing an oven door which is mounted for pivoting about a vertical hinge axis adjacent to an edge of an oven access opening, which hinge axis is positioned a distance back from the front of the oven. As a result of the position of the hinges which is permitted with a concave oven door, the radius of the arc of travel defined by the door upon opening it, is reduced compared to a door which is hinged at the front of the oven. According to another feature of the invention, an oven door is provided which has a concave interior recessed surface defining an interior space. A food-holding rack which may be a wire grid or a tray is supported in the oven so that a portion of the rack, grid, or tray is positioned within the interior space defined by the concave recessed interior of the oven door. As a result of the concave interior recess of the door, convenient loading and unloading of the rack is facilitated. When this feature is combined with a hinge axis position spaced back from the front of the oven, further space-saving advantages are achieved.

According to another feature of the invention, convenient access is facilitated with a circular tray, which is rotatable within the oven and which is mounted partially within a heated interior volume and partially within the recessed concave interior of the door.

According to another feature of the invention, the door has a convex exterior surface and a rotatable rack, which rack is supported from the door and is driven in rotation through a door-mounted mechanism. Preferably, the drive mechanism is mounted toward a hinged side of the door so that a minimum frontal clearance is required for opening the door.

According to another feature of the invention, a door-mounted circular rack is rotated through engageable contact with a drive mechanism which is not door-mounted, but which is located within the heated interior of the Oven.

According to another feature of the invention, a centrally driven rotatable oven rack is provided with a sanitary central down-turned drip lip which shields the drive mechanism from the accumulation of foodstuffs, grease, and debris, which is common with previously known central drive rotatable oven racks. Preferably, a flexible seal is further provided interposed between the drive mechanism and the drip lip to further seal the drive mechanism from cooking spills and splatters.

According to another feature of the invention, the concave interior of the door is formed with an exterior and interior sheet of steel drawn into corresponding recessed shapes spaced apart and fastened together around the edges to form a gap therebetween. The exterior sheet is maintained at a cooled temperature by filling the gap with insulative material during construction or by providing convection air passage therethrough from the bottom to the top of the door.

BRIEF DESCRIPTION OF THE DRAWINGS

The foregoing and other objects and advantages of the invention will be more fully understood with reference to the following disclosure, claims, and drawings in which like numerals represent like elements and in which:

DETAILED DESCRIPTION OF THE PREFERRED EMBODIMENTS

Figure 1:
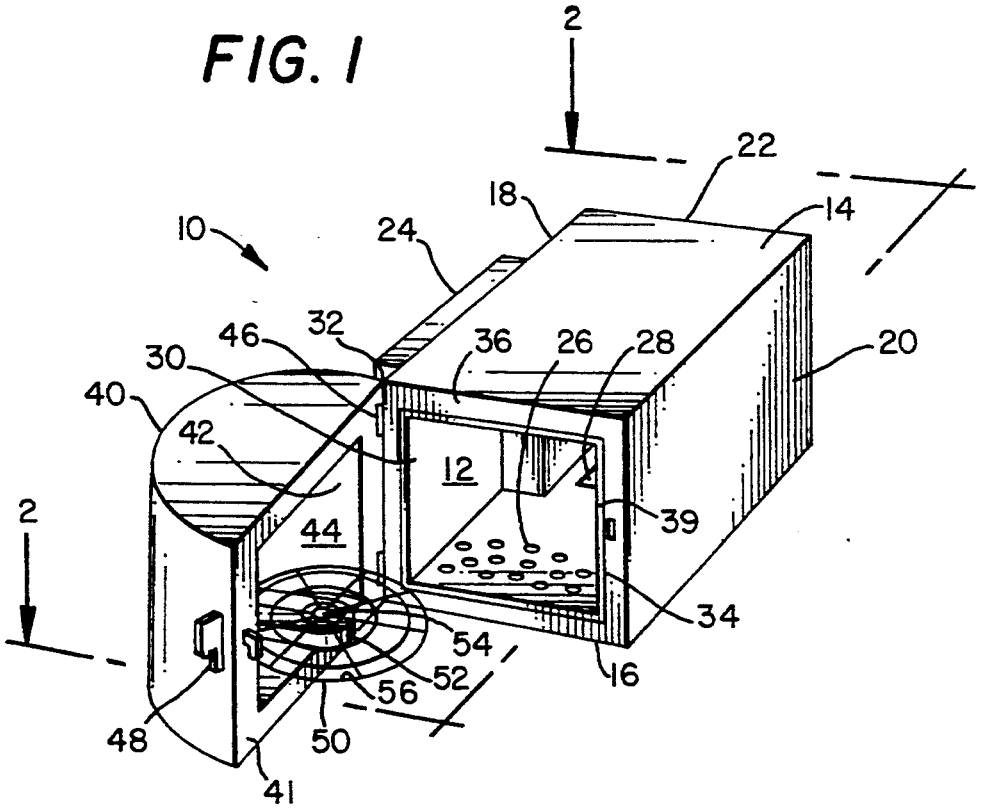
FIG. 1 is a perspective view of an oven, including an oven door with a concave interior, according to the present invention.

FIG. 1 shows a perspective view of an oven 10 according to the present invention. The oven includes a heated interior volume 12. For example, interior volume 12 may be defined by closed top 14, closed bottom 16, closed left side 18, closed right side 20, closed back 22 and an access 30 which may, for example, be an open face 30. There is a heat source 24 in communication with the interior, which heat source 24 may, for example, be a convection heat source, a radiant heat source, a microwave heat source, or a hot air impingement heat source, such as a system known as the Jet Sweep ® air impingement heating unit created by Enersyst Development Center, Inc. Heat source 24 communicates heating energy to the heated interior volume 12 as, for example, through air jet channels 26 and return vent 28 which may be used as in a Jet Sweep ® oven. Those skilled in the art will recognize the alternative types of heating elements required within the interior heated volume 12, depending upon the type of heat source 24 employed in a particular oven.

In order to make the heated interior volume 12 both accessible and enclosable, door 40 is operatively connected to oven 10 adjacent to access 30 or open face 30 for opening and closing volume 12 at access 30. Access 30 may be an open face 30 may be a planar open face, but might also be a non-planar opening, depending on the oven configuration desired. The preferred embodiment shown in FIG. 1 has a vertical planar open face 30 which includes a vertical left edge 32 and a vertical right edge 34. Horizontal top and bottom edges 36 and 38 are also shown in the embodiment of FIG. 1. The open face 30 may be provided with a flexible heat seal 39 extending substantially continuously around each of the edges 32, 34, 36, and 38 as is known in the oven art. Door 40 is attached to the oven, adjacent to open face 30. Door 40 has an engaging face 41, which is sized and shaped for corresponding engagement with the edges around open face 30. It will be understood that seal 39 may be carried on engaging face 41 without interfering with the operation thereof.

Inventive door 40 has a concave interior surface 42 which defines a concave interior space 44. Preferably, door 40 is pivotably or hingeably connected, as at hinge axis 46, to an edge 32 of oven 10. Advantageously, the hinge connection 46 is adjacent to open face 30 spaced back from the front of oven 10, such as vertically along either a left vertical edge 32 or a right vertical edge 34 as will be more fully discussed below. A latch 48 is attached for holding door 40 in a closed position over open face 30. In the closed position, space 44 is adjacent to and contiguous with interior volume 12. Heat from heated interior volume 12 is transmitted into space 44 but is prevented from escaping directly into the atmosphere through open face 30.

A heating rack or tray 50 is positioned for extending partially into the interior volume 12 and partially into the interior space 44 when door 40 is in a closed position. While a rack 50 is preferably constructed as a circular wire grid with holes or openings therethrough, other shapes or constructions could be used. For example, a circular, square, or polygon-shaped grid, or a square, polygon, or circular tray which might be a perforated or a non-perforated tray sized for fitting partially into volume 12 and partially into space 44 could be used in place of the circular rack 50 without departing from various aspects of the present invention. In order to advantageously increase accessibility to the heating rack 50, it may be advantageously supported from door 40 as with a support structure 52, which in the embodiment shown, extends from concave interior surface 42 a horizontal distance therefrom. In this configuration, heat rack 50 will extend horizontally partially into interior heating volume 12 and partially into space 44. Support 52 may further advantageously include a rotational connection means 54 which allows rack 50 to rotate. Horizontal orientation of rack 50 advantageously allows the entire top surface 56 of rack 50 to carry articles for heating, which articles are held thereon by the normal force of gravity. Rotation of rack 50 moves all portions of rack 50 through interior heating volume 12 during at least a portion of one complete revolution and thereby facilitates even heating over the entire top surface 56.

Figure 2:
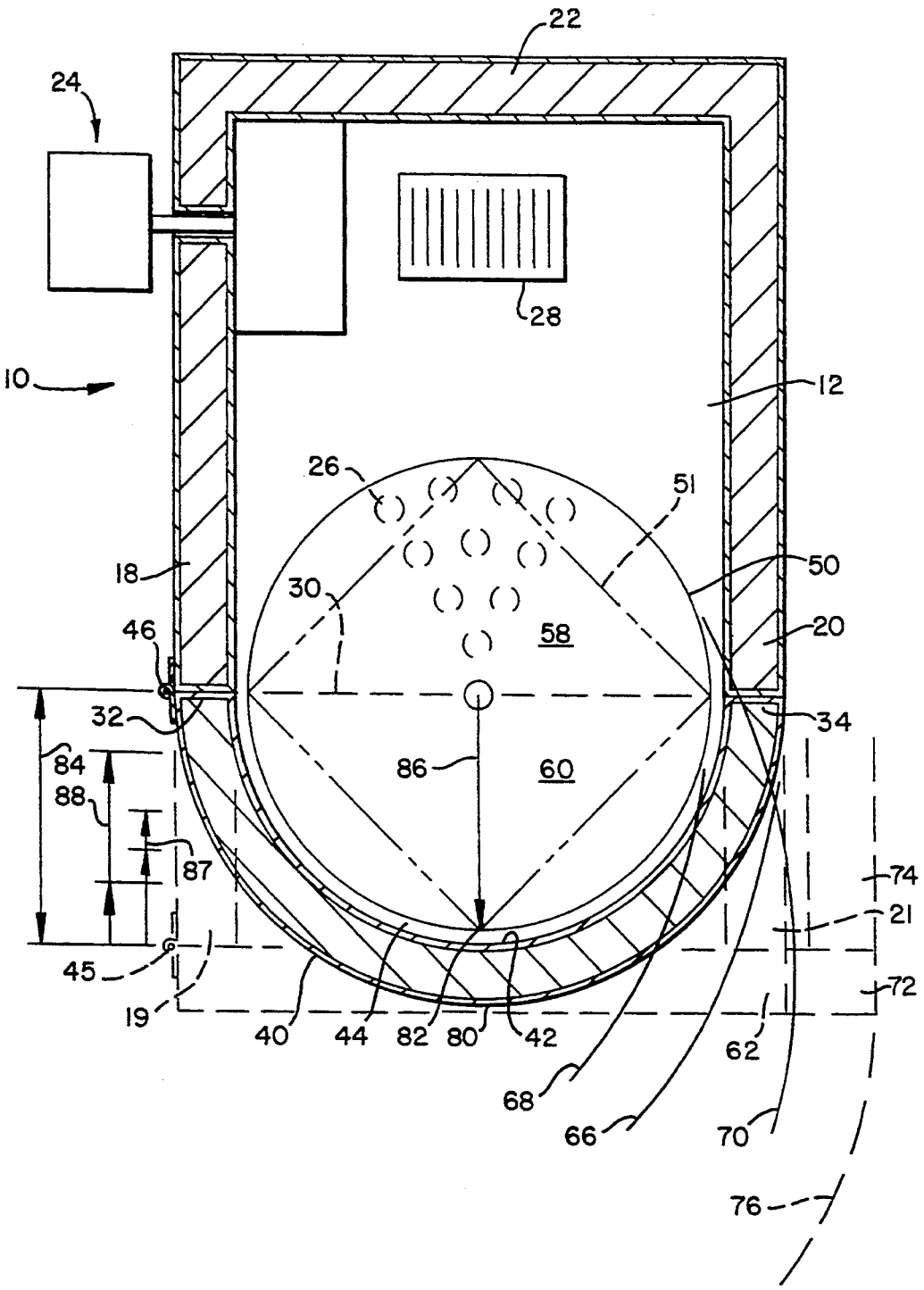
FIG. 2 is a top cross-sectional schematic view of an oven demonstrating a hinge axis position spaced back from the front of the oven to produce a reduced door-opening arc and also reduced space requirements for an oven according to the present invention.

With reference to FIG. 2, which is a top cross-sectional schematic view of an oven according to the present invention, further advantages of a door 40 having a concave interior surface 42 and corresponding convex exterior portion 142 will be better understood. In this view, door 40 is shown in a closed position (an open position is shown in FIG. 1). One end of door 40 is hingeably connected as with hinge axis 46 adjacent vertical edge 32 of open face 30. The opposite end of door 40 is sealingly closed against edge 34 as with latch 48. Rack 50 is mounted with a portion 58 thereof within enclosable heated volume 12 and another portion 60 thereof positioned within space 44, which space 44 is defined by concave surface 42 and open face 30.

Advantageously, easy access and reduced frontal clearance is achieved for both ovens with door-mounted rotary racks and for ovens with oven-mounted rotary racks. In both cases, when door 40 is closed, the racks project partially into space 44 defined by interior concave surface 42 and partially into interior volume 12. If the rack is oven-mounted, outwardly projecting portion 60 is easily accessible upon opening door 40. If the rack is door-mounted, inwardly projecting portion 58 is easily accessible upon opening door 40. An oven door 40 with a concave interior and which is pivoted about hinge axis 46 according to the present invention defines a small radius pivot arc. Thus, reduced frontal clearance distance is required.

Also shown schematically in FIG. 2 with phantom lines for purposes of comparison, is flat oven door 62 and imaginary in a position which would typically be occupied by a flat oven door 62, if one were used to accommodate the same size circular rack or tray 50 within an oven. In the case of an oven using a flat door construction, it will be seen that oven sides 18 and 20 would extend forward of open face 30 as indicated with phantom lines at 19 and 21, respectively. Also, flat door 62 pivoted about a hinge 45, positioned as depicted in phantom lines, would move through an arc 64 which has a larger radius than that of a pivot arc 66 for an oven 10 and concave door 40 according to the invention with a convex portion 142.

Further, in the event that rack 50 is mounted to and supported from the oven door 40, the rack 50 when pivoted about door mount hinge axis 46 according to the present invention, would traverse a maximum arc 68 with a reduced radius as indicated. Similar maximum arcs 66 and 68 would be defined by a square or other polygon-shaped rack 51 (shown in phantom lines) of a size which could be inscribed within the circular shape or rack 50.

For purposes of comparison, it is noted that if a similarly sized rack 50 were similarly mounted to an imaginary flat door 62, then in that event, it would move through a maximum arc 70 when pivoted about imaginary hinge 45. The rack 50 would be moved into a side wall 21 positioned as shown and could not be moved out of such a narrow oven. Thus, in the case of a flat door 62, a wider oven would therefore need to be constructed for the same size rotatable door-mounted rack. Door 62 would necessarily be correspondingly longer as shown with phantom lines 72 and the position of a side wall 74 would necessarily be more widely spaced from wall 18 as indicated with phantom lines in FIG. 2. Thus, an elongated flat door 72 pivoted about a hinge 45 would move through a maximum arc 76 and would require both greater frontal clearance and also a wider side spacing between side walls 18 and 74.

It has been found advantageous in the present invention to mount rotary rack 50 to door 40 so that convenient open access can be had to portion 58 of rack 50. Portion 58 projects into the closable volume 12 of oven 10 when it is closed and preferably, constitutes more than about fifty percent (50%) of the rack area. Similar convenient open access is not available where the entire rack 50 is mounted within volume 12 and remains within oven 10. Further it is advantageous to provide a door 40 with a concave interior surface 42 so that the door 40 may therefore be pivoted about a hinge axis 46 which is spaced back from the front of the oven in order to decrease both the arc of travel 66 of the door 40 and the arc of travel 68 of the rack 50 mounted to the door 40.

It has been found that a position of hinge axis 46 which is spaced back from front 80 of oven 10 advantageously reduces the radius of the arc of door travel 66 and the arc of rack travel 68. The radii of arcs 66 and 68 are reduced more and more as the spaced back distance 84 is increased more and more. Distance 84 represents the horizontal distance from the hinge axis 46 to the front 82 of rack 50, in a closed oven. The radii of arcs 66 and 68 are reduced more and more until hinge axis 46 is positioned behind front 82 of rack 50 a distance which is equal to the radius 86 of a circular rack 50. However, it has also been found that for optimum heating in most ovens and further, for optimum, convenient access to top surface 56 of rack 50, the position of hinge axis 46 is preferably defined within a distance range 88, which is between about $\frac{1}{8}$ and $\frac{7}{8}$ of the radius of 86 of circular rack 50. This corresponds to a spaced back distance of between about 1/16 and 7/16 of the maximum dimension of a polygon inscribable within a similarly sized circle. Most preferred, it has been found that a positioning distance 84 would be within a distance range 85 which is between about $\frac{1}{2}$ and $\frac{1}{3}$ of radius 86 of circular rack 50. This corresponds to a spaced back distance of between about $\frac{1}{4}$ and 1/6 of the maximum dimension of a polygon inscribable within a similarly sized circle.

The preferred position of hinge axis 46 is more clearly shown in FIGS. 4, 5, 6, and 8 which are all top cross-sectional views of alternative embodiments of ovens according to the present invention, showing alternative constructions and mounting configurations for rotary drive motors and drive mechanisms for rack 50.

Figure 3:
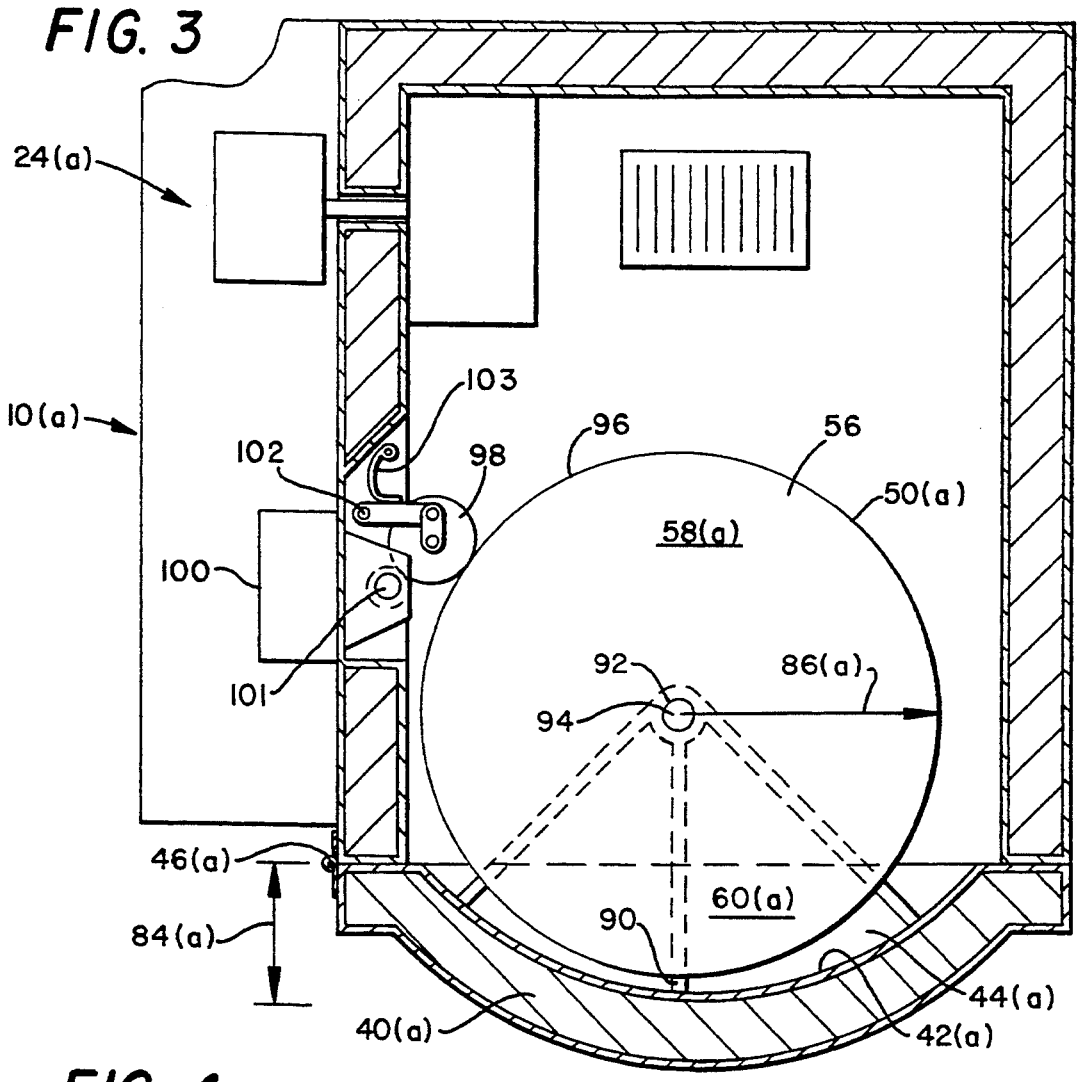
FIG. 3 is a top cross-sectional view of another embodiment of an oven showing an alternative oven-mounted rotary rack drive according to the present invention.

With specific reference to FIG. 3, a door 40(*a*) has a concave interior surface 42(*a*) defining an interior space 44(*a*). A hinge axis 46(*a*) is positioned a distance 84(*a*) behind an imaginary hinge 45, positioned substantially corresponding to front 82(*a*) of rack 50(*a*). As a comparison, an imaginary hinge 45 as would be positioned substantially even with front 82(*a*) of rack 50(*a*) for a flat door on an oven with a similarly sized rack 50 similarly positioned within interior heated volume 12 of the oven. A support structure 90 supports rack 50(*a*) from door 40(*a*). Rack 50(*a*) is held for rotation, as for example, a rotation mechanism 91 which may include a bearing 92 and a shaft 94, which may be held by support structure 90. In the embodiment shown in FIG. 3, a drive mechanism 105(*a*) is oven-mounted and includes an edge 96 of rack 50(*a*) which engages an idler wheel 98, which idler wheel 98 is pivotably mounted to oven 10(*a*) for rolling engagement with drive wheel 101 of motor 100, as at pivot 102, and is biased inwardly as with spring 103 to put sufficient frictional contact force between drive wheel 101, idler wheel 98 and edge 96 to rotate rack 50(a). If rotation tends to lead the idler wheel 98 into more pressure, the idler wheel 98 needs little spring action. It will be understood that drive wheel 101, idler wheel 98, and edge 96 may be formed as gears having correspondingly engageable gear teeth. However, such teeth would need to be appropriately constructed, as with rounded tips so that non-binding meshing between the gears is achieved upon closing door 40. Food placed across the entire top surface 56 of rack 50 may be evenly heated by rotating rack 50, even though the heat energy may directly impinge only on inwardly projecting portion 58 of rack 50. It is noted that in the embodiment shown in FIG. 3, distance 84(*a*) is less than rack radius 86(*a*), so that portion 58 within interior volume 12 is substantially larger than portion 60 which projects into interior space 44(*a*).

Figure 4:
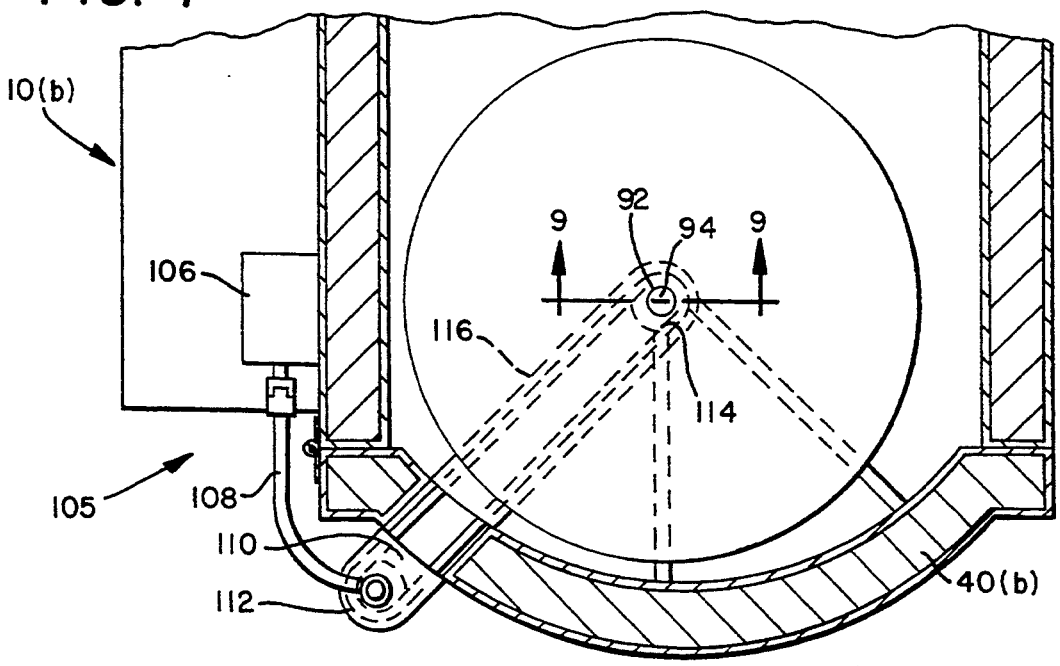
FIG. 4 is a top cross-sectional view of another alternative embodiment of an oven showing an oven-mounted motor and flexible drive shaft and a through-the-door rotary rack drive according to the present invention.

With reference to FIG. 4, an alternative drive mechanism 105(*b*) is shown. A motor 106 is coupled through a flexible drive shaft 108 to a power transmission member 110. Rotational power is thus transferred from motor 106 through flexible shaft 108 and into rack 50(*b*) through shaft 94 projecting through bearing 92. Power transmission 110 may, for example, comprise spaced apart pulleys 112 and 114 with a flexible belt 116 endlessly communicating between the pulleys. (It will be understood that power transmission 110 may alternatively comprise a gear transmission or a sprocket and chain transmission without departing from the invention.)

Figure 5:
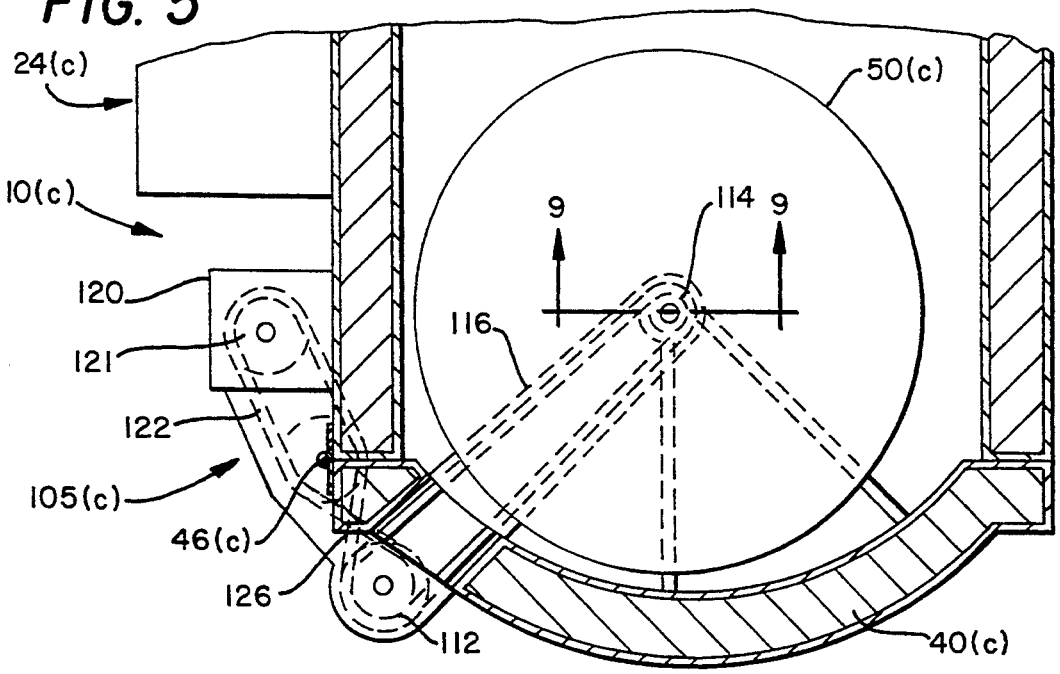
FIG. 5 is a top cross-sectional view of another alternative embodiment showing an oven-mounted motor and door-mounted flexible belt rotary rack drive.

FIG. 5 depicts a partial cross-sectional top view of an alternative embodiment of a rotary drive mechanism 105(*c*) for a rotary table 50(*c*) according to the present invention, in which a motor 120 is mounted to oven 10(*c*) as at side 18(*c*). Motor 120 drives a pulley 112 (or sprocket 112) and through flexible continuous belt 116 (or chain 116) drives pulley 114 (or sprocket 114) to rotate rack 50(*c*). Another flexible belt or band 122 is routed from motor drive pulley 121 around a pair of idler pulleys 124, which idler pulleys are mounted for rotation about an axis which is coaxially aligned with the hinge axis 46(*c*). Belt 122 is thus twisted at 126 and routed around pulley 112, so that the length of continuous belt 122 remains the same regardless of the opening position of door 40(*c*).

Figure 6:
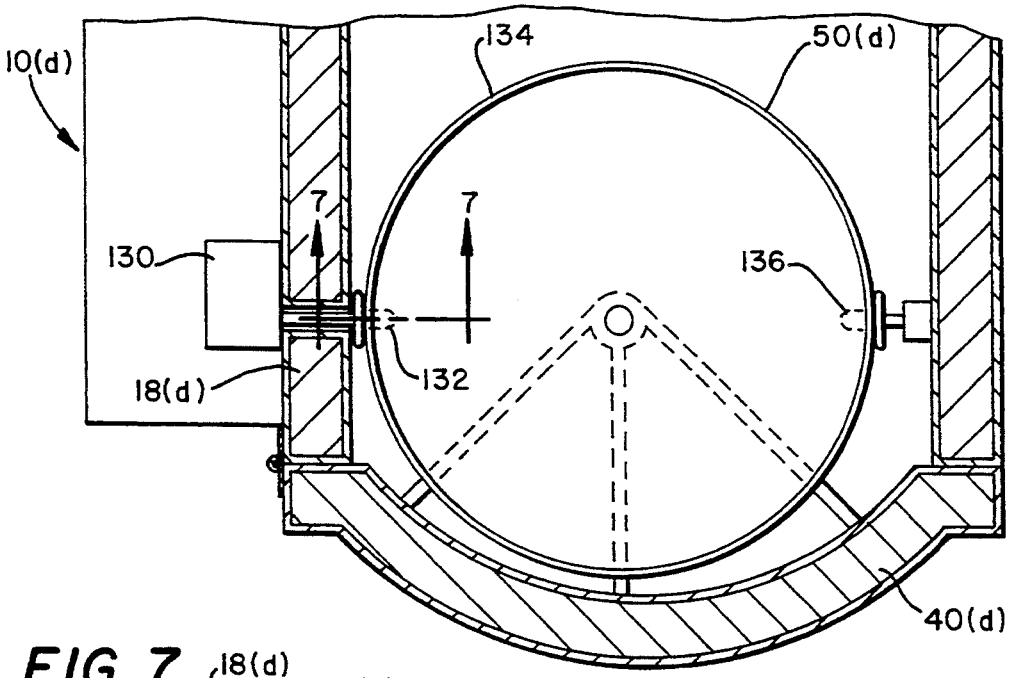
FIG. 6 is a top cross-sectional view of another alternative embodiment of an oven showing an alternative oven-mounted rotary rack drive according to the present invention.

FIG. 6 depicts a partial top cross-sectional view of another embodiment of the invention in which a drive motor 130 is mounted to an oven 10(*d*) having a drive roller 132 positioned at a fixed location for rotation within interior heated volume 12(*d*). Drive wheel 132 is appropriately located for rolling engagement against a bottom rim 134 around the lower circumference of rack 50(*d*). An idler roller 136 with a horizontal rotation axis may also be positioned diametrically opposite drive wheel 136 to counter-balance any potential tipping induced by engagement of drive roller 132 with lower rim 134. It will be understood that drive roller 132 may alternatively be constructed as a gear or sprocket with corresponding gear teeth formed circumferentially around bottom rim 134. Again, appropriately constructed teeth will facilitate non-binding engagement or smooth meshing between the gear teeth.

Figure 7:
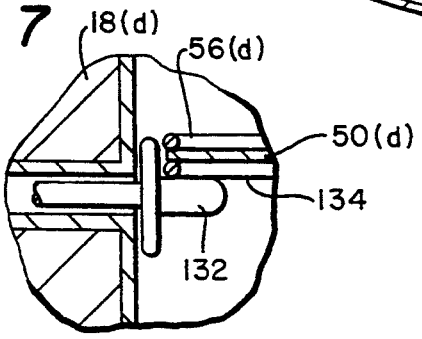
FIG. 7 is a partial section view of the rotary rack drive mechanism of FIG. 6 according to the present invention.

FIG. 7 is a partial section view taken along section line 7—7 of FIG. 6, showing a preferred drive roller 132 engaging rim 134 of rack 50(*d*). A smooth roller 132 formed of a high temperature polymer material is preferred to facilitate non-binding engagement and disengagement as the door is opened and closed while providing adequate rolling friction to drive rack 50(*d*).

Figure 8:
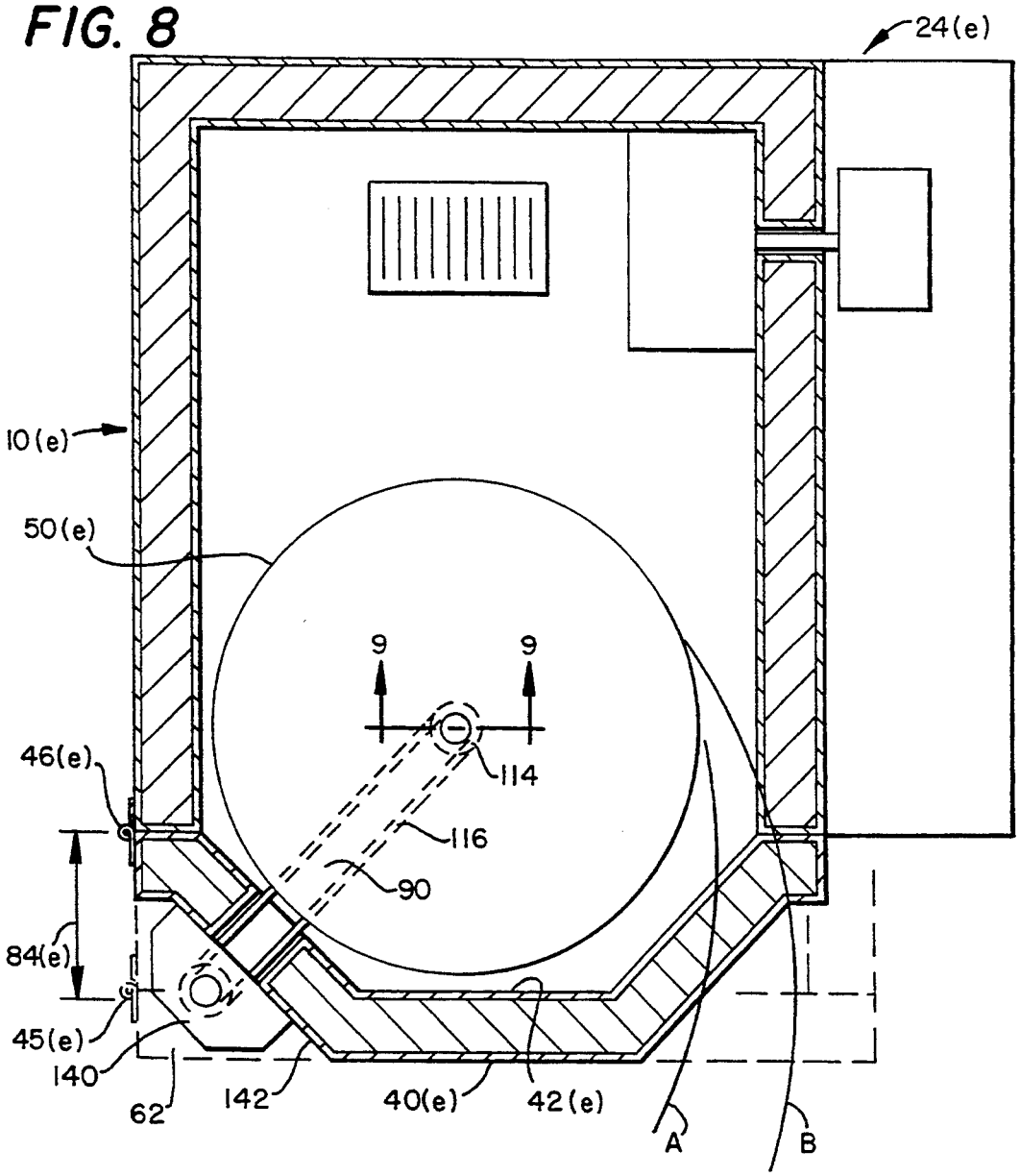
FIG. 8 is a top plan view of an alternative embodiment of an oven with a door-mounted motor and rack drive.

Referring to FIG. 8, an alternative construction of door 40(*e*) is shown in which straight sections rather than curved sections are used to define a concave interior surface 42(*e*). In this embodiment, rotary drive motor 140 is mounted directly to door 40(*e*) along a convex exterior portion 142 of door 40(*e*) which angles back toward hinge 46(*e*). In this manner, motor 140 can be positioned so as not to project beyond the space which would normally be occupied by a flat door 62 positioned to accommodate the same size rack 50(*e*). Motor 140 drives a pulley (or sprocket) 116 which in turn drives a pulley (or sprocket) 114, as through a continuous flexible belt (or chain) 116.

Figure 9:
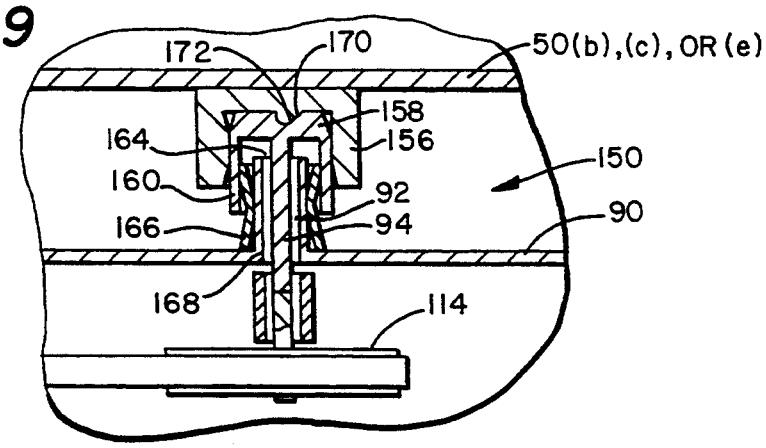
FIG. 9 is a partial section view taken along section line 9—9 of FIGS. 4, 5, or 8, showing an improved shielded rotation mechanism according to one aspect of the present invention, which is useful with alternative embodiments of centrally driven rotary racks.

With specific reference to FIG. 9, which is a cross-sectional view taken along section line 9—9 of FIGS. 4, 5, or 8, a further unique and advantageous aspect of the invention is depicted in the form of a shielded sanitary drive mechanism 150. In this embodiment, pulley (or sprocket) 114 drives shaft 94. Shaft 94 extends through bearing 92 which is mounted through upwardly projecting bearing mount 152 which is attached to support member 90. Bearing 92 and bearing mount 152 project a predetermined distance upwardly from support member 90. A hollow cylinder 156 with a closed top 155 and downwardly extending first drip lip 157 is mounted or formed at the center of rack 50(*b*), (*c*), or (*e*). Hollow cylinder 156 has an interior diameter correspondingly sized for receiving a driving head 158, Driving head 158 is rigidly attached to or formed on shaft 94. Driving head 158 further includes a second downwardly extending drip lip 160 which is larger than and projects downwardly over upwardly projecting bearing 92 and mount 152. Thus, any liquid spills or other heated materials will normally drip from rack 50 straight down off of first drip lip 156 onto a cleanable surface 162 on support member 90. Further, any splattering materials, such as grease or the like, which moves around first drip lip 156 will also encounter second drip lip 160 which will further shield open end 164 of bearing 92 from encountering any such splatters or spillage. In most cases, the drip lip arrangement will successfully avoid collection of organic material in the drive mechanism. However, to further facilitate shielding of any organic material from entering gap 164 between bearing 92 and shaft 94, a temperature-resistant flexible seal 166 may also be interposed between the interior of drip lip 160 and mounting flange 152 of bearing 154.

Further advantageously and in order to avoid jamming of rotary rack 50 and any damage resulting to the drive motor 140 or the drive mechanism attached thereto, upper end of drive head 158 of drive shaft 94 is advantageously provided with an angled detent 170. A corresponding dog 172 is formed on the underside of top 155 of hollow cylinder 156. Dog 172 is maintained in contact within angled detent 170 by normal gravitational force and the weight of rack 50. If rack 50 becomes jammed, then the dog 172 rides upwardly and out of angled detent 170, so that shaft 94 may continue to rotate without jamming, breaking, or otherwise damaging the motor or other portions of the drive mechanism.

Figure 10:
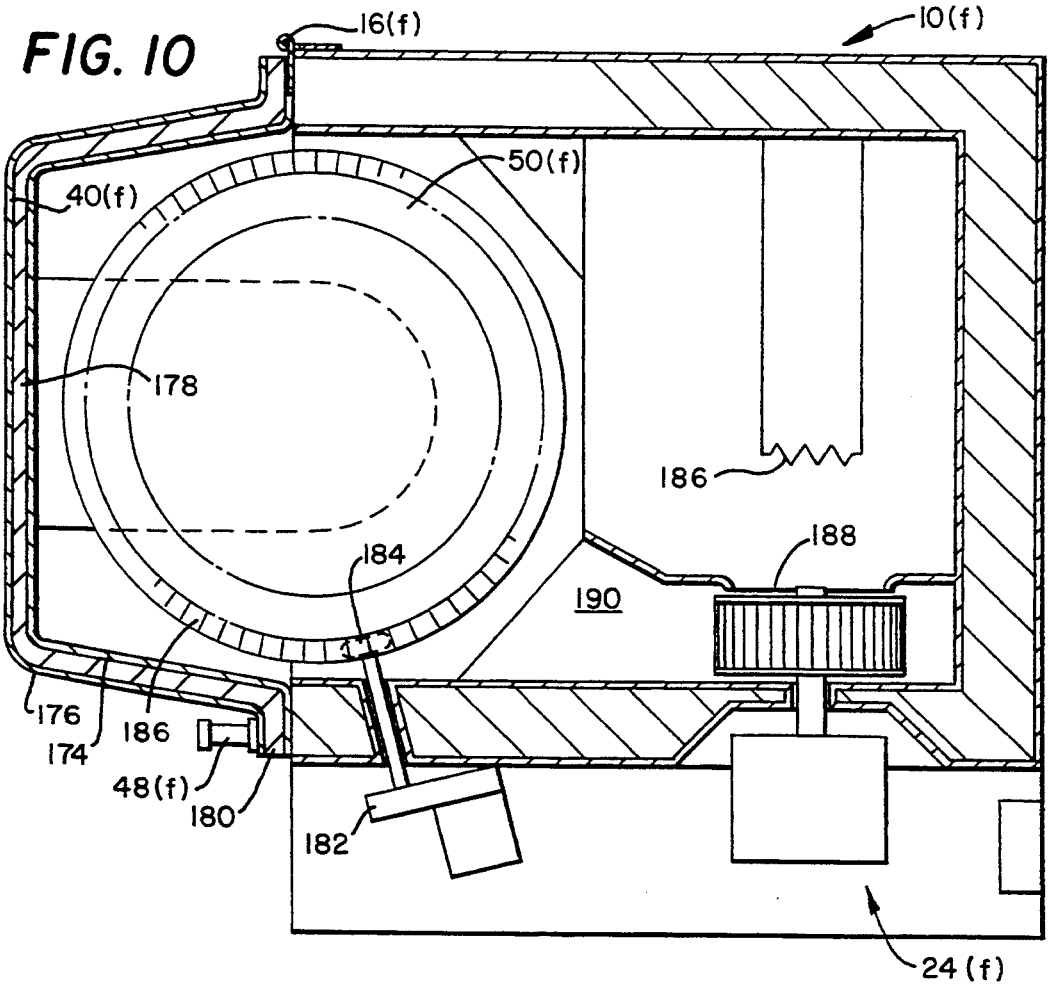
FIG. 10 is a top cross-sectional view of an alternative embodiment of an oven with a recessed interior surface door, in which embodiment a toothed rim and corresponding motor and drive gear are schematically depicted, which motor is positioned in the oven opposite from the door hinge.

FIG. 10 is a schematic top cross-sectional view of an alternative embodiment of an oven 10(*f*) in which the oven door 40(*f*) is constructed of an interior drawn sheet of metal 174 which is formed in the desired concave interior surface shape according to the present invention. An exterior drawn sheet of metal 176 is correspondingly formed with a similar concave or recess shape for fitting over the drawn sheet 174 in a spaced apart manner with a gap 178 therebetween. Drawn sheets 174 and 176 are attached to one another as around edge 180. In order to keep the exterior drawn sheet 176 cooled, insulative material may be inserted into gap 178 during construction. Alternatively, gap 178 may be left substantially empty to provide a convection cooling passage from the top to the bottom therethrough (as will be more fully explained with respect to the embodiment depicted in FIG. 11.) In the embodiment shown in FIG. 10, it will be noted that door 40(*f*) is hingeably connected to oven 10(*f*) at hinge 46(*f*) which is positioned opposite from drive motor 182, which is positioned in the oven opposite from hinge 46(*f*). In the embodiment shown, motor 182 drives a spur gear 184. Gear 184 drives the rotary rack, table or tray 50(*f*) having a toothed rim 186 formed circumferentially therearound. In the particular embodiment shown, the heat source 24(*f*) includes an electrical resistance coil 186 with a fan 188 and a directional conduit 190 by which heated air is directed to the rack, table or the tray 50(*f*).

Figure 11:
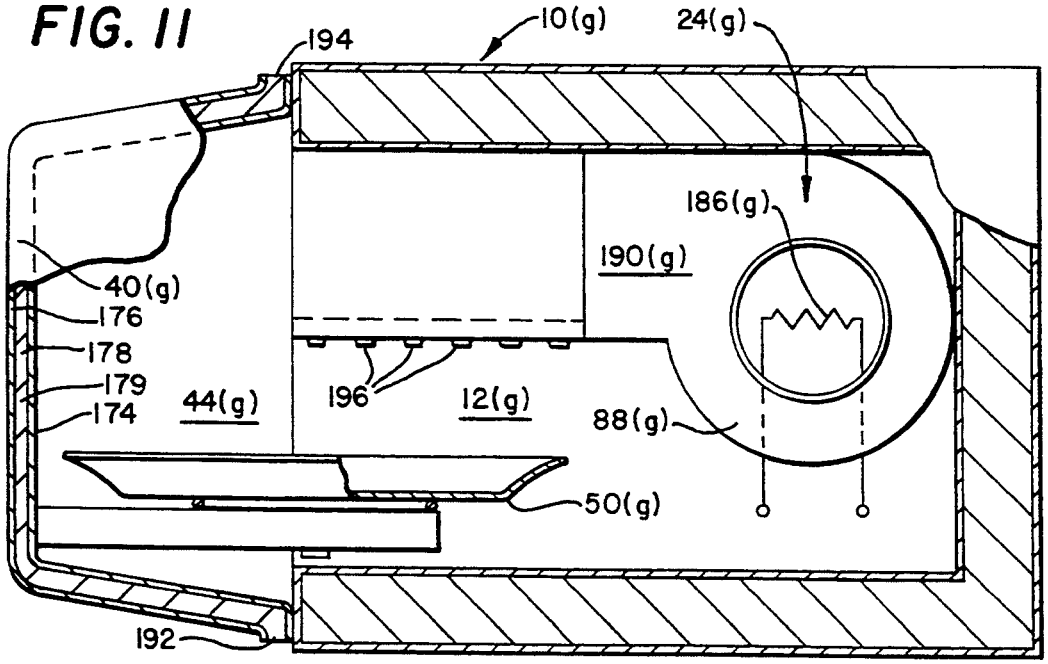
FIG. 11 is a partially cut-away side view of an alternative embodiment of the inventive oven having a recessed interior surface door in which a rotary tray is depicted with overhead heating jets and in which the oven door is constructed for convection cooling.

FIG. 11 is a partial cut-away side view of an alternative embodiment of an oven 10(*g*) with an oven door 40(*g*) constructed similar to the construction of oven door 40(*f*) of FIG. 10, with an interior drawn sheet 174 and an exterior drawn sheet 176, having a gap 178 therebetween. In the embodiment shown in FIG. 11, gap 178 is not completely filled with an insulative material, but rather is at least partially empty to provide a convection air cooling passage 179 therethrough having a bottom entry 192 and a top exit 194. In this manner, heat from interior volume 12(*g*) and interior recess space 44(*g*) is conducted through interior oven door plate 174 so that air within cooling passage 179 in gap 178 becomes heated and rises, drawing cool air into passage entry 192 allowing the heated air to exit through passage exit 194. Further in this embodiment, a heating tray 50(*g*) is provided and directional heating passage 190(*g*) interconnects with discharge jets 196 which cause heated air to impinge upon the top food or other materials carried on tray 50(*g*).

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. An oven comprising:

(a) a heated interior volume;

(b) an open face access into said heated interior volume; and (c) a concave door mounted on an axis aligned with said open face access adjacent to said heated interior volume for pivoting between closed access and opened access positions and having a concave interior surface defining an interior space adjacent to said heated interior volume so that a pivot radius is defined that is shorter than a pivot radius for an imaginary flat door configured for enclosing a same size interior space and heated interior volume.

2. An oven as in claim 1 further comprising a rack supported partially within said heated volume and partially within said interior space defined by said concave interior door surface when said concave door is in said closed access position so that said rack pivots with said concave door to define a rack arc having a radius which is less than an imaginary radius for an imaginary rack of a same size on said imaginary flat door.

3. An oven as in claim 2 further comprising:

(a) a support structure fastened to said door and projecting from said concave interior surface a horizontal distance into said heated interior volume when said door is in said closed access position; and (b) a rotation mechanism held by said support structure for engaging said rack for rotation thereof.

4. An oven as in claim 3 wherein:

(a) said rack is circular shaped; and (b) said rotation mechanism includes a vertical shaft and bearing interconnecting said support structure and said circular-shaped rack at a center portion thereof to hold said rack in a horizontal rotational orientation.

5. An oven as in claim 3 further comprising heated air jets directed downwardly toward said rack supported partially within said heated volume.

6. An oven as in claim 3 further comprising heated air jets directed upwardly against said rack supported partially within said heated volume.

7. An oven as in claim 3 further comprising:

(a) heated air jets directed downwardly against said rack support partially within said heated volume; and (b) heated air jets directed upwardly against said rack supported partially within said heated volume.

8. An oven as in claim 4 further comprising:

(a) a rotational drive motor mounted to said oven door; and (b) power transmission means connected between said door-mounted rotational drive motor and said rack for rotation of said rack.

9. An oven as in claim 8 wherein said power transmission means connected between said motor and said rack further comprise:

(a) a first pulley directly driven by said motor in rotation about a vertical axis;

(b) a second pulley mounted to a center of said rack for rotation therewith; and (c) a continuous flexible belt interconnecting between said first and second pulleys fox transmission of rotational power therebetween.

10. An oven as in claim 8 wherein said power transmission means connected between said motor and said rack further comprise:

(a) a first sprocket directly driven by said motor in rotation about a vertical axis;

(b) a second sprocket mounted to a center of said rack for rotation therewith; and (c) a continuous chain interconnecting between said first and second sprockets for transmission of rotational power therebetween.

11. An oven as in claim 4 further comprising:

(a) a rotational drive motor mounted to said oven; and (b) a power transmission means connecting between said motor and said rack for rotation of said rack.

12. An oven as in claim 11 wherein said power transmission means connecting between said motor and said rack for rotation of said rack further comprises:

(a) a pulley connected centrally located to said rack and a second pulley rotationally mounted to said door with a continuous belt extending therebetween; and (b) a flexible drive shaft extending from said oven-mounted motor to said second pulley for rotating said second pulley and thereby driving through said continuous belt the first pulley and the rack attached thereto.

13. An oven as in claim 11 wherein said power transmission means connecting between said motor and said rack for rotation of said rack further comprises:

(a) a first sprocket connected centrally located to said rack and a second sprocket rotationally mounted to said door with a continuous chain extending therebetween; and (b) a flexible drive shaft extending from said oven-mounted motor to said second sprocket for rotating said second sprocket and thereby driving through said continuous belt the first sprocket and the rack attached thereto.

14. An oven as in claim 11 wherein said power transmission means connecting between said motor and said rack for rotation of said rack further comprises:

(a) a circular rim attached to said rack; and (b) a drive wheel receiving rotational power from said motor and positioned in said interior heated volume for engagement against said circular rim of said rack.

15. An oven as in claim 8 wherein:

(a) said circular rim comprises a lower rim; and (b) said drive wheel comprises a wheel rotatable about a horizontal axis positioned below said rack for engagement with said lower rim.

16. An oven as in claim 15 wherein:

(a) said lower rim has gear teeth formed circumferentially therearound; and (b) said horizontally rotatable drive wheel has gear teeth formed therearound for engagement with said gear teeth of said rim.

17. An oven as in claim 14 wherein said circular rim of said rack comprises:

(a) a vertically disposed edge; and (b) said drive wheel comprises a heat-resistant wheel rotatable about a vertical axis and positioned for rolling engagement against said vertically disposed edge when said oven door is closed.

18. An oven as in claim 17 wherein:

(a) said vertically disposed periphery rim has gear teeth formed therearound; and (b) said drive wheel comprises a vertically rotatable gear formed and positioned for meshing engagement with said gear teeth of said rim when said oven door is closed.

19. An oven as in claim 11 wherein said power transmission means further comprises:

(a) a first pulley rotationally mounted about a vertical axis to said door, a second pulley mounted for rotation with the center of the rack, and a first continuous drive belt therebetween; and (b) a drive pulley mounted on said motor, a third pulley coaxially mounted for rotation with said first pulley, an idler pulley mounted coaxially with the door hinge, and a flexible continuous belt extending in parallel sections from said drive pulley to said idler pulley and twistedly engaged around said third pulley so that the length of the second flexible belt remains constant at any open or closed position of said oven door.

20. An oven as in claim 11 wherein said power transmission means further comprises:

(a) a first sprocket rotationally mounted about a vertical axis to said door, a second sprocket mounted for rotation with the center of the rack, and a first continuous drive chain therebetween; and (b) a drive pulley mounted on said motor, a third pulley coaxially mounted for rotation with said first sprocket, an idler pulley mounted coaxially with the door hinge, and a second flexible continuous belt extending in parallel sections from said drive pulley to said idler pulley and twistedly engaged around said third pulley so that the length of the second flexible belt remains constant at any open or closed position of said oven door.

21. An oven comprising:

(a) a heated interior volume;

(b) an access into said heated interior volume;

(c) a door mounted for pivoting about a vertical hinge axis adjacent said access, said door pivotable between closed access and opened access positions;

(d) a horizontal rack mounted at least partially within said heated volume with a distal portion of said horizontal rack projecting a predetermined distance beyond said vertical hinge axis; and (e) said door having an interior recess into which said distal portion of said rack projects with said door in said closed access position.

22. An oven as in claim 21 wherein said horizontal rack includes a central portion and further comprising a rotation mechanism connected to said central portion of said horizontal rack for rotation of said horizontal rack, such that said distal portion of said horizontal rack moves through said heated interior volume during one complete revolution.

23. An oven as in claim 22 further comprising a support structure mounted to said door for supporting said rotation mechanism with said horizontal rack thereon.

24. An oven as in claim 23 further comprising:

(a) a door-mounted motor; and (b) a door-mounted transmission means for transmitting rotational power from said motor to said rotation mechanism and said horizontal rack mounted thereon for rotation of said horizontal rack.

25. An oven as in claim 23 further comprising:

(a) an oven-mounted motor; and (b) an oven-mounted transmission for rotation of said horizontal rack about said rotational mechanism.

26. An oven as in claim 23 comprising:

(a) an oven-mounted motor; and (b) a door-mounted power transmission for receiving power from said oven-mounted motor and for transmitting said rotational power to said rotational mechanism for rotating said horizontal rack.

27. An oven as in claim 26 further comprising a flexible drive shaft from said motor to said door-mounted transmission, by which said door-mounted transmission receives rotational power from said motor.

28. An oven as in claim 26 further comprising:

(a) a drive pulley rotated by said motor;

(b) a pair of idler pulleys coaxially mounted with the pivot axis of said door;

(c) a power receiving pulley on said door-mounted transmission; and (d) a flexible belt routed from said drive pulley around said pair of idler pulleys and twisted around said power receiving pulley on said door-mounted transmission so that the length of the belt is maintained constant as said door is pivoted between said opened and said closed positions.

29. An oven as in claim 22 further comprising:

(a) a first cylindrical drip lip mounted to said central portion of said rack directed downwardly therefrom;

(b) a vertical shaft having a head portion sized for engaging centrally within said first drip lip extending downwardly from said horizontal rack and having a second cylindrical drip lip having a hollow portion further extending downwardly therefrom;

(c) a bearing mounted within a vertical housing for rotationally holding said vertical shaft and extending at least partially upward into said downwardly extending portion of said second cylindrical drip lip of said shaft head.

30. An oven as in claim 29 further comprising a flexible seal interposed between said upwardly extending bearing mount and the downwardly extending hollow portion of said second cylindrical drip lip.

31. An oven as in claim 21 wherein said predetermined distance which said distal portion of said horizontal rack projects beyond said vertical hinge axis is between about 1/16 and 7/16 of a maximum horizontal distance across said horizontal rack.

32. An oven as in claim 21 wherein said predetermined distance beyond said vertical hinge by which said distal portion of said horizontal rack projects is between about 1/6 and $\frac{1}{4}$ of a maximum horizontal dimension of said horizontal rack.

33. An oven as in claim 21 wherein said horizontal rack has a circular shape with a predetermined diameter.

34. An oven as in claim 33 wherein said predetermined distance which said horizontal circular rack projects horizontally beyond said vertical hinge axis is between about $\frac{1}{8}$ and $\frac{7}{8}$ of a radius of said circular rack.

35. An oven as in claim 33 wherein said predetermined distance which the distal portion of said horizontal circular rack projects beyond said vertical hinge axis is between $\frac{1}{3}$ and $\frac{1}{2}$ of a radius of said circular rack.

36. An oven as in claim 21 further comprising air jets in said heated interior volume directed vertically downwardly against said horizontal rack mounted at least partially within said heated volume.

37. An oven as in claim 21 further comprising heated air jets directed upwardly toward said horizontal rack mounted at least partially within said heated volume.

38. An oven as in claim 21 further comprising:

(a) a first set of heated air jets directed downwardly against said horizontal rack mounted at least partially within said heated volume; and (b) a second set of heated air jets directed upwardly against said horizontal rack mounted at least partially within said heated volume.

39. An oven comprising:

(a) a heated interior volume;

(b) an access into said heated interior volume;

(c) a .door mounted adjacent to said heated interior volume for pivoting between closed access and opened access positions;

(d) a rack supported at least partially within said heated volume when said door is in said closed access position;

(e) a support structure fastened to said door and projecting a horizontal distance into said heated interior volume when said door is in said closed access position;

(f) a rotation mechanism held by said support structure for engaging said rack for rotation thereof and including a vertical shaft and bearing interconnecting said support structure and said rack at a center portion thereof to hold said rack in a horizontal rotation orientation;

(g) a rotational drive motor mounted to said oven;

(h) a power transmission means connecting between said motor and said rack for rotation of said rack, including:

(i) a pulley connected centrally located to said rack and a second pulley rotationally mounted to said door with a continuous belt extending therebetween; and (ii) a flexible drive shaft extending from said oven-mounted door to said second pulley for rotating said second pulley and thereby driving through said continuous belt the first pulley and the rack attached thereto.

40. An oven comprising:

(a) a heated interior volume;

(b) an access into said heated interior volume;

(c) a door mounted adjacent to said heated interior volume for pivoting between closed access and opened access positions;

(d) a rack supported at least partially within said heated volume when said door is in said closed access position;

(e) a support structure fastened to said door and projecting a horizontal distance into said heated interior volume when said door is in said closed access position;

(f) a rotation mechanism held by said support structure for engaging said rack for rotation thereof and including a vertical shaft and bearing interconnecting said support structure and said rack at a center portion thereof to hold said rack in a horizontal rotation orientation;

(g) a rotational drive motor mounted to said oven; and (h) a power transmission means connecting between said motor and said rack for rotation of said rack, including:

(i) a first sprocket connected centrally located to said rack and a second sprocket rotationally mounted to said door with a continuous chain extending therebetween; and (ii) a flexible drive shaft extending from said oven-mounted motor to said second sprocket for rotating said second sprocket and thereby driving through said continuous belt the first sprocket and the rack attached thereto.

41. An oven comprising:

(a) a heated interior volume;

(b) an access into said heated interior volume;

(c) a door mounted adjacent to said heated interior volume for pivoting between closed access and opened access positions;

(d) a rack supported at least partially within said heated volume;

(e) a support structure fastened to said door and projecting a horizontal distance into said heated interior volume when said door is in said closed access position;

(f) a rotation mechanism held by said support structure for engaging said rack for rotation thereof and including a vertical shaft and bearing interconnecting said support structure and said rack at a center portion thereof to hold said rack in a horizontal rotation orientation;

(g) a rotational drive motor mounted to said oven; and (h) a power transmission means connecting between said motor and said rack for rotation of said rack, including:
(i) a circular rim attached to said rack; and
(ii) a drive wheel receiving rotational power from said motor and positioned in said interior heated engagement against said circular rim of said rack.

42. An oven comprising:
(a) a heated interior volume;
(b) an access into said heated interior volume;
(c) a door mounted adjacent to said heated interior volume for pivoting between closed access and opened access positions;
(d) a rack supported at least partially within said heated volume when said door is in said closed access position;
(e) a support structure fastened to said door and projecting a horizontal distance into said heated interior volume when said door is in said closed access position;
(f) a rotation mechanism held by said support structure for engaging said rack for rotation thereof and including a vertical shaft and bearing interconnecting said support structure and said rack at a center portion thereof to hold said rack in a horizontal rotation orientation;
(g) a rotational drive motor mounted to said oven; and
(h) a power transmission means connecting between said motor and said rack for rotation of said rack, including:
(i) a first pulley rotationally mounted about a vertical axis to said door, a second pulley mounted for rotation with the center of the rack, and a first continuous drive belt therebetween; and
(ii) a drive pulley mounted on said motor, a third pulley coaxially mounted for rotation with said first pulley, an idler pulley mounted coaxially with the door hinge, and a flexible continuous belt extending in parallel sections from said drive pulley to said idler pulley and twistedly engaged around said third pulley so that the length of the second flexible belt remains constant at any open or closed position of said oven door.

43. An oven comprising:
(a) a heated interior volume;
(b) an access into said heated interior volume;
(c) a door mounted adjacent to said heated interior volume for pivoting between closed access and opened access positions;
(d) a rack supported at least partially within said heated volume when said door is in said closed access position;
(e) a support structure fastened to said door and projecting a horizontal distance into said heated interior volume when said door is in said closed access position;
(f) a rotation mechanism held by said support structure for engaging said rack for rotation thereof and including a vertical shaft and bearing interconnecting said support structure and said rack at a center portion thereof to hold said rack in a horizontal rotation orientation;
(g) a rotational drive motor mounted to said open; and
(h) a power transmission means connecting between said motor and said rack for rotation of said rack, including;
(i) a first sprocket rotationally mounted about a vertical axis to said door, a second sprocket mounted about a rotation with the center of the rack, and a first continuous drive chain therebetween; and
(ii) a drive pulley mounted on said motor, a third pulley coaxially mounted for rotation with said first sprocket, an idler pulley mounted coaxially with the door hinge, and a second flexible continuous belt extending in parallel sections from said drive pulley to said idler pulley and twistedly engaged around said third pulley so that the length of the second flexible belt remains constant at any open or closed position of said oven door.

44. An oven comprising:
(a) a heated interior volume;
(b) an access into said heated interior volume;
(c) a door mounted adjacent to said heated interior volume for pivoting between closed access and opened access positions;
(d) a rack supported at least partially within said heated volume when said door is in said closed access
(e) a support structure fastened to said door and projecting a horizontal distance into said heated interior volume when said door is in said closed access position;
(f) a rotation mechanism held by said support structure for engaging said rack for rotation thereof and including a vertical shaft and bearing interconnecting said support structure and said rack at a center portion thereof to hold said rack in a horizontal rotation orientation;
(g) a rotational drive motor mounted to said oven door; and
(h) power transmission means connected between said door-mounted rotational drive motor and said rack for rotation of said rack, including:
(i) a first pulley directly driven by said motor in rotation about a vertical axis;
(ii) a second pulley mounted to a center of said rack for rotation therewith; and
(iii) a continuous flexible belt interconnecting between said first and second pulleys for transmission of rotational power therebetween, 45. An oven comprising:
(a) a heated interior volume;
(b) an access into said heated interior volume;
(c) a door mounted adjacent to said heated interior volume for pivoting between closed access and opened access positions;
(d) a rack supported at least partially heated volume when said door is in said closed access position;
(e) a support structure fastened to said door and projecting a horizontal distance into said heated interior volume when said door is in said closed access position;
(f) a rotation mechanism held by said support structure for engaging said rack for rotation thereof and including a vertical shaft and bearing interconnecting said support structure and said rack at a center portion thereof to hold said rack in a horizontal rotation orientation;
(g) a rotational drive motor mounted to said oven; and (h) a power transmission means connecting between said motor and said rack for rotation of said rack, including:

(i) a first sprocket directly driven by said motor in rotation about a vertical axis;

(ii) a second sprocket mounted to a center of said rack for rotation therewith; and (iii) a continuous chain interconnecting between said first and second sprockets for transmission of rotational power therebetween.

46. An oven comprising:

(a) a heated interior volume;

(b) an access into said heated interior volume;

(c) a door mounted for pivoting about a vertical hinge axis adjacent said access, said door pivotable between closed access and opened access positions;

(d) a horizontal rack mounted at least partially within said heated volume with a distal portion of said horizontal rack projecting a predetermined distance beyond said vertical hinge axis, including a central portion and further comprising a rotation mechanism connected to said central portion of said horizontal rack for rotation of said horizontal rack, such that said distal portion of said horizontal rack moves through said heated interior volume during one complete revolution;

(e) a support structure mounted to said door for supporting said rotation mechanism with said horizontal rack thereon;

(f) an oven-mounted motor;

(g) a door-mounted power transmission for receiving power from said oven-mounted motor and for transmitting said rotational power to said rotational mechanism for rotating said horizontal rack;

(h) a drive pulley rotated by said motor;

(i) a pair of idler pulleys coaxially mounted with the hinge axis of said door;

(j) a power receiving pulley on said door-mounted transmission; and (k) a flexible belt routed from said drive pulley around said pair of idler pulleys and twisted around said power receiving pulley on said door-mounted transmission so that the length of the belt is maintained constant as said door is pivoted between said opened and said closed positions.

47. An oven comprising:

(a) a heated interior volume;

(b) an access into said heated interior volume;

(c) a door mounted for pivoting about a vertical hinge axis adjacent said access, said door pivotable between closed access and opened access positions;

(d) a horizontal rack mounted at least partially within said heated volume with a distal portion of said horizontal rack projecting a predetermined distance beyond said vertical hinge axis, including a central portion and further comprising a rotation mechanism connected to said central portion of said horizontal rack for rotation of said horizontal rack, such that said distal portion of said horizontal rack moves through said heated interior volume during one complete revolution;

(e) a first cylindrical drip lip mounted to said central portion of said rack directed downwardly therefrom;

(f) a vertical shaft having a head portion sized for engaging centrally within said first drip lip extending downwardly from said horizontal rack and having a second cylindrical drip lip having a hollow portion further downwardly therefrom; and (g) a bearing mounted within a vertical housing for rotationally holding said vertical shaft and extending at least partially upward into said downwardly extending portion of said second cylindrical drip lip of said shaft head.

* * * * *

UNITED STATES PATENT AND TRADEMARK OFFICE
CERTIFICATE OF CORRECTION

PATENT NO. : 5,365,918

DATED : November 22, 1994

INVENTOR(S) : Donald P. Smith, et al.

It is certified that error appears in the above-identified patent and that said Letters Patent is hereby corrected as shown below:

At Column 2, line 45, replace "Oven" with --- oven ---.

At Column 5, line 40, after the word "convex", insert --- exterior ---.

At Column 6, line 47, after "44(a)", insert --- and a corresponding convex exterior portion 142(a) ---.

At Claim 39, Column 14, line 3, after the word "oven;", insert --- and ---.

At Claim 43, Column 15, line 67, replace the word "open" with --- oven ---.

At Claim 43, Column 16, line 6, replace the words "about a" with --- for ---.

At Claim 44, Column 16, line 26, after the word "access", insert --- position ---.

At Claim 45, Column 16, line 55, after the word "partially", insert --- within said ---.

UNITED STATES PATENT AND TRADEMARK OFFICE

CERTIFICATE OF CORRECTION

PATENT NO. : 5,365,918

DATED : November 22, 1994

INVENTOR(S) : Donald P. Smith, et al.

It is certified that error appears in the above-indentified patent and that said Letters Patent is hereby corrected as shown below:

At Claim 47, Column 18, line 32, after the word "further", insert ---extending--.

Signed and Sealed this

Fifteenth Day of August, 1995

Bruce Lehman

*Attest:*

BRUCE LEHMAN

*Attesting Officer*

*Commissioner of Patents and Trademarks*